United States Patent [19]

Robert

[11] 4,164,101

[45] Aug. 14, 1979

[54] SANDING HEAD INCLUDING A DUST EXTRACTING SHAFT CASING

[75] Inventor: Jean Robert, Paris, France

[73] Assignee: La Francaise Metallurgie, Paris, France

[21] Appl. No.: 887,598

[22] Filed: Mar. 17, 1978

[30] Foreign Application Priority Data

Mar. 18, 1977 [FR] France ..... 77 08135

[51] Int. Cl.[2] ..... B24B 55/06

[52] U.S. Cl. ..... 51/273; 51/358

[58] Field of Search ..... 51/170 T, 356, 362, 51/358, 378, 379, 376, 377, 273, 177, 170 MT, 170 R

[56] References Cited

U.S. PATENT DOCUMENTS

| | | | |
|---|---|---|---|
| 1,353,966 | 9/1920 | Lorenz | 51/379 |
| 1,765,808 | 6/1930 | Tone | 51/356 |
| 2,527,762 | 10/1950 | Pratt | 51/356 |
| 3,638,362 | 2/1972 | Stoll | 51/273 |
| 3,754,359 | 8/1973 | Scandaletos | 51/356 |
| 3,932,966 | 1/1976 | Stern | 51/356 |

FOREIGN PATENT DOCUMENTS 2212773 7/1974 France .

*Primary Examiner*—Robert Louis Spruill
*Assistant Examiner*—Roscoe V. Parker

[57] ABSTRACT

A sanding head providing for the extraction of dust produced during sanding, and comprising a shaft casing, a shaft rotatably mounted in the casing and capable of being driven by motor means, a circular backing plate of a ventilated type, which is connected to one end of the shaft, said circular backing plate being provided in its front face with ventilating grooves and having in its center a hollow cylindrical element, which has a closed front end and which is provided, adjacent its closed front end, with lateral windows communicating the inside of the hollow cylindrical element with the ventilating grooves, and a means for detachably fixing an abrasive disk to the closed front end of the hollow cylindrical element. The hollow cylindrical element of the plate is rotatably mounted in the shaft casing at one end thereof, whereas the shaft is rotatably mounted only at the other end of the casing. The shaft, on the one hand, and the casing and the hollow cylindrical element of the backing plate, on the other hand, have respective diameters selected to provide a wide space therebetween. The shaft casing comprises between its two ends a lateral dust outlet pipe for connection to a vacuum cleaner.

7 Claims, 3 Drawing Figures

SANDING HEAD INCLUDING A DUST EXTRACTING SHAFT CASING

BACKGROUND OF THE INVENTION

The present invention relates to a sanding head providing for the extraction of the dust produced during sanding, including a shaft casing, a shaft rotatably mounted in the casing and capable of being driven by motor means, a circular backing plate of a ventilated type which is connected to one end of the shaft, said circular backing plate being provided in its front face with ventilating grooves and having in its center a hollow cylindrical element which has a closed front end and which is provided, adjacent its closed front end, with lateral windows communicating the inside of the hollow cylindrical element with the ventilating grooves, and means for detachably fixing an abrasive disk to the closed front end of the hollow cylindrical element.

Applicant's U.S. patent application Ser. No. 835,699 filed on Sept., 22, 1977, already discloses a sanding apparatus comprising a sanding head of the above described type. In the sanding apparatus described in said U.S. patent application, the extraction of dust caused by the abrasive paper disk takes place through the drive shaft of the backing plate, which is formed as a hollow shaft. The rotation of the hollow shaft is obtained by means of two bevel gears which are fixed respectively to the hollow shaft and to the shaft of the motor of the sanding apparatus, as in conventional sanding apparatus in which the output shaft, to which the circular backing plate is fixed, extends perpendicularly to the longitudinal axis of the body of the sanding apparatus which contains the drive motor. In the above mentioned U.S. patent application, it is also contemplated to adapt the casing of the sanding head to a motor unit, e.g. the motor unit of a drilling apparatus, for instance on electric drill, capable of receiving different accessories. However, whereas the use of two shafts at right angles and two bevel gears fixed respectively on said shafts is rational in the case of a sanding apparatus in which these elements already exist and are disposed in the same way, such an arrangement is less rational in the case of a sanding head adaptable to the motor unit of an electric drill able to receive different accessories. In fact, the use of two shafts at right angles, one of which is hollow, and two bevel gears, complicates the construction of the sanding head and increases its cost price.

SUMMARY AND OBJECTS OF THE INVENTION

The main object of the present invention is to provide a sanding head, with dust extraction, which is simple in construction and inexpensive, whereby it can be mass-produced for distribution in the general public.

To this end, the sanding head of the present invention is characterized in that the hollow cylindrical element of the plate is rotatably mounted in the shaft casing at one end thereof, whereas the shaft is rotatably mounted only at the other end of the casing, in that the shaft, on the one hand, and the casing and the hollow cylindrical element of the plate, on the other hand, have respective diameters selected to provide a wide space therebetween, in that the shaft casing comprises between its two ends a lateral dust outlet pipe intended for connection to a vacuum cleaner.

Other objects and advantages of the present invention will become more readily apparent upon reference to the accompanying drawings and following description.

DESCRIPTION OF THE PREFERRED EMBODIMENTS

Figure 1:
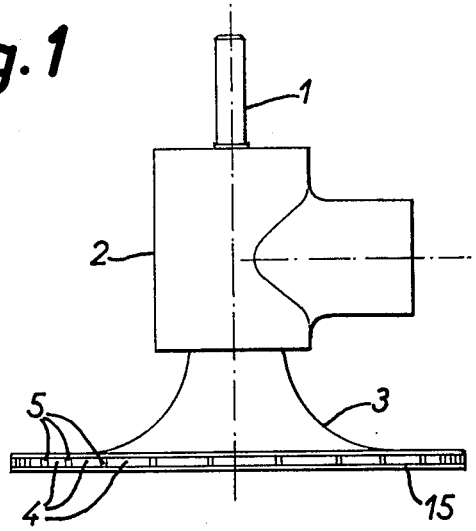
FIG. 1 is an elevational view of a sanding head according to the present invention which is constructed in the form of an accessory adaptable to electric drill capable of receiving various accessories.

The sanding head shown in FIG. 1 comprises essentially, in a known way, a shaft 1 rotatably mounted in a casing 2 and mechanically connectible to the drive motor of an electric drill (not shown), and a circular backing plate 3 which is connected to one end of shaft 1. Backing plate 3 is a plate of a known ventilated type which comprises in its front face ventilating grooves or channels 4 formed, formed, for example, by spiral-shaped ribs 5 projecting from the front face of plate 3.

Figure 2:
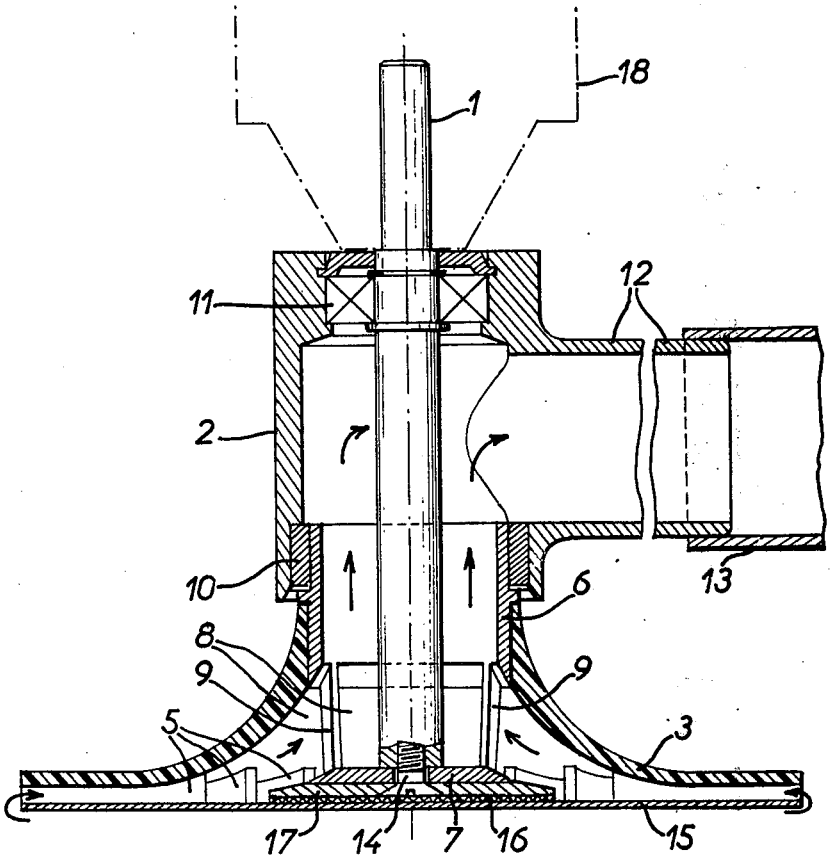
FIG. 2 is an enlarged vertical section of the sanding head of FIG. 1.
Figure 3:
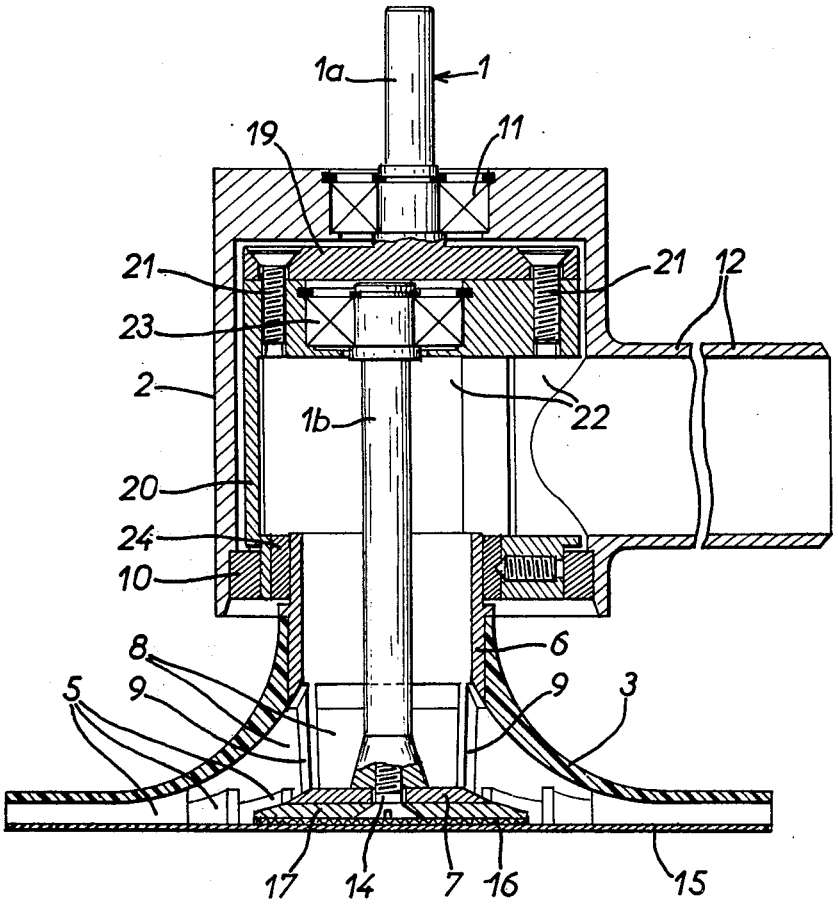
FIG. 3 is a view similar to FIG. 2 showing a modified embodiment in which the circular backing plate can be driven with an orbital movement.

As shown in FIGS. 2 and 3, backing plate 3 has in its center, as is known, a hollow cylindrical element 6 which is closed at its front or lower end by an end wall 7 which can be integral with the hollow cylindrical element 6. In the cylindrical wall of element 6 are formed, adjacent end wall 7, wide windows 8 communicating the inside of element 6 with the ventilating grooves formed between ribs 5. For example, there can be formed three windows 8 separated by three uprights 9, only two of which can be seen in FIGS. 2 and 3, which are angularly spaced 120° apart and which connect the end wall 7 to the cylindrical wall of element 6.

Backing plate 3 can, for example, be formed, in a known way, from moulded resin and the hollow cylindrical element 6 can be formed as a metal insert partly embedded in the central part of backing plate 3 during the moulding thereof. However, hollow cylindrical element 6 may be fixed in any other appropriate way to the backing plate. For example, a part of the cylindrical wall of element 6 can be threaded on the outer side thereof and the backing plate can be provided with a tapped central hole for receiving the threaded part of element 6.

As shown in FIG. 2, according to the present invention, the hollow cylindrical element 6 is rotatably mounted in the lower end of the shaft casing 2 by means of a bearing 10, which can for example be a bushing, whereas shaft 1 is rotatably mounted only at the upper end of the shaft casing 2 by means of a bearing 11 which is aligned with bearing 10 and which can be for example a ball bearing, preferably of a dust-proff type.

Between its two ends, casing 2 is provided with a lateral outlet pipe 12 connectable to a vacuum cleaner, not shown. Preferably pipe 12 has a standard diameter for fitting to a flexible pipe 13 of a household vacuum cleaner. Furthermore pipe 12 can advantageously be long enough to serve as a handle.

In the embodiment shown in FIG. 2, shaft 1 extends coaxially inside casing 2 and hollow cylindrical element 6 to the wall 7 of element 6, to which it is fixed by an axial securing screw 14 which passes through a central hole in wall 7 upwards and which is screwed into an axial tapped hole in the lower end of shaft 1.

An abrasive paper disk 15 can be removably fixed to backing plate 3. Said abrasive disk 15 can be advantageously secured to backing plate 3 by means of a quick release device 16 of the "Velcro" type. Quick release devices of the "Velcro" type are well known and comprise a first fabric having one face thereof provided with a multitude of little hooks, and a second fabric having one face thereof provided with a multitude of little loops engageable with the hooks of the first fabric when the two fabrics are pressed one against the other. In the present case, one of the two fabrics, e.g. the one provided with little loops, is stuck to the face of disk 15 which is not coated with the abrasive means, whereas the other fabric, e.g. the one provided with little hooks, is stuck to a washer 17 having a diameter slightly greater than that of end wall 7 of element 6. Washer 17 is itself secured to wall 7 by screw 14 which has preferably a conical countersunk head for fitting into a corresponding conical recess of the central hole of washer 17. With the quick release device 16 of the "Velcro" type, disk 15 can be easily and quickly fitted or removed for replacement by another abrasive disk.

Abrasive disk 15 could be removably secured to backing plate 3 in any other conventional way. For example, instead of providing the quick release device 16, disk 15 could be clamped between the end wall 7 of element 6 and washer 17 which, in this case, can have a smaller diameter than that shown in FIG. 2.

Shaft 1 extends upwards beyond bearing 11, so that its upper end projects outside casing 2. Thus, the upper end of shaft 1 can be engaged and clamped in the mandrel 18 (partially shown in dash-and-dot line in FIG. 2) of a drilling apparatus, not shown, for instance a conventional electric drill, so that shaft 1 is rotated by the drive motor of the electric drill.

In operation, pipe 12 is connected to a vacuum cleaner, e.g. by the flexible pipe 13, so as to suck up the dust which is generated by the abrasive disk 15 and which is projected by centrifugal force towards the periphery of the disk. As shown by the arrows in FIG. 2, the dust which is sucked up at the periphery of disk 15, travels along the ventilating channels formed between ribs 5, passes through windows 8, then through the hollow cylindrical element 6 and casing 2, and finally through the lateral pipe 12 of casing 2, from where it is led by pipe 13 to the vacuum cleaner. The abrasive disk 15 can, in a known manner, be provided with several holes which communicate with the ventilating channels of backing plate 3 and through which the dust can also be evacuated.

So as to facilitate the extraction and the flow of the dust, windows 8 are as wide as possible, and the outside diameter of shaft 1, on the one hand, and the respective inside diameters of the hollow cylindrical element 6 and of casing 2, on the other hand, are selected so as to provide therebetween as wide a space as possible.

In the embodiment which is shown in FIG. 2, backing plate 3 is driven with a rotational movement about its axis. FIG. 3 shows another embodiment in which backing plate 3 can be driven with an orbital movement about the axis of shaft 1. In FIG. 3, the elements which are identical or which have the same function as the elements shown in FIG. 2 bear the same reference numbers.

The sanding head shown in FIG. 3 differs from that shown in FIG. 2 in that shaft 1 is in two separate parts 1*a* and 1*b* parallel to each other. Part 1*a* of the shaft is rotatably mounted in bearing 11 at the upper end of casing 2 and it projects outside casing 2 so that it can be engaged and clamped in the mandrel of an electric drill. At its lower end part 1*a* of shaft 1 carries a circular plate 19 which can be formed integral with part 1*a* of the shaft or which can be secured thereto by any appropriate means. An intermediate hollow cylindrical element 20 is concentrically disposed inside casing 2. At its upper end, hollow cylindrical element 20 is secured by screws 21 to plate 19, so that its axis merges into the axis of part 1*a* of shaft 1. At its lower end hollow cylindrical element 20 is rotatably mounted in the lower end of casing 2 by means of bearing 10, the axis of which is aligned with that of bearing 11. Several wide windows 22 are formed in the peripheral wall of hollow cylindrical element 20 at the level of the lateral pipe 12 of casing 2.

At its two ends, hollow cylindrical element 20 have bearings 23 and 24, the axes of which are aligned with each other but offset in relation to the axis of part 1*a* of shaft 1. Bearing 23 can be, for example, formed by a ball bearing, preferably of a dust-proof type. Bearing 24 can be, for example, formed by a bushing. The hollow cylindrical element 6 of backing plate 3 is rotatably mounted in bushing 24 at the lower end of the hollow cylindrical element 20. The second part 1*b* of shaft 1 is rotatably mounted at its upper end in ball bearing 23 at the upper end of element 20. The lower end of part 1*b* of shaft 1 is secured to the end wall 7 of element 6 by screw 14.

With the embodiment shown in FIG. 3, when part 1*a* of the shaft is rotated by the drive motor of an electric drill and disk 15 is applied to an object to be sanded, part 1*b* of the shaft executes an orbital movement about the axis of part 1*a*. The extraction of the dust is carried out in the same way as in the case of the embodiment shown in FIG. 2.

It will be of course understood that the two embodiments of the present invention which have been described above have been given solely as examples and are in no way limitative, and that numerous modifications can be made within the scope of the present invention. Thus, although in the preceding description shaft 1 has an upper end which projects beyond the upper end of casing 2 so that it can be engaged and clamped in the mandrel of an electric drill for driving the shaft 1, the driving of said shaft could be achieved in any other way known per se. For example, in some commercially available electric drills capable of receiving different accessories, the clamping mandrel is removable and the end of the output shaft of the drive motor of the electric drill is provided with a square driving end or is splined. In this case, the upper end of shaft 1 of the sanding head of the present invention can, of course, be provided with a recess adapted to receive, as the case may be, the square section end of the splined end of the drive shaft of the electric drill. Furthermore, in some commercially available electric drills capable of receiving different accessories, the accessories can be secured to the body of the electric drill either by a bayonet fitting or by means of a split clamping collar forming part of the casing of the accessory and able to be fitted and clamped on a cylindrical part of the body of the electric drill surrounding the output end of the drive shaft of the electric drill. It goes without saying that, if it is so desired, the casing 2 of the sanding accessory of the invention can also comprise such a bayonet fitting or such a split clamping collar.

Furthermore, although the sanding head has been described herein and illustrated in the accompanying drawings in the form of an accessory which can be adapted to the motor unit of a drilling apparatus capable of receiving various accessories, the sanding head of the invention can be an integral part of a sanding machine. In this case, the casing of the sanding head of the invention can be secured to or can constitute an integral part of the housing of the sanding machine.

While the invention has been shown and described with particular reference to the preferred embodiments, it will be apparent that many variations are possible that would fall within the scope of the present invention which is not intended to be limited except as defined in the following claims.

What is claimed is:

1. In a sanding head providing for the extraction of dust produced during sanding, and comprising a shaft casing, a shaft rotatably mounted in the casing and capable of being driven by motor means, a circular backing plate of a ventilated type which is connected to one end of the shaft, said circular backing plate being provided in its front face with ventilating grooves and having in its center a hollow cylindrical element, which has a closed front end and which is provided, adjacent its closed front end, with lateral windows communicating the inside of the hollow cylindrical element with the ventilating grooves, and means for detachably fixing an abrasive disk to the closed front end of the hollow cylindrical element, the improvement consisting in that: the hollow cylindrical element of the backing plate is rotatably mounted in the shaft casing at one end thereof, whereas the shaft is rotatably mounted only at the other end of the casing; the shaft, on the one hand, and the casing and the hollow cylindrical element of the backing plate, on the other hand, have respective diameters selected to provide a wide space therebetween; and the shaft casing comprises between its two ends a lateral dust outlet pipe for connection to a vacuum cleaner.

2. The sanding head according to claim 1, wherein the shaft extends coaxially inside the casing and the hollow cylindrical element of the backing plate to the closed front end of the hollow cylindrical element to which it is fixed by an axial securing screw.

3. The sanding head according to claim 1, wherein: said shaft is in two separate parts parallel to each other, a first part of the shaft being rotatably mounted at the upper end of the casing, and wherein an intermediate hollow cylindrical element is disposed concentrically inside the casing, said intermediate hollow cylindrical element being provided with windows in its lateral wall at the level of the lateral pipe of the casing, being coaxially connected at its upper end to the first part of the shaft and being rotatably mounted at its lower end in the lower end of the casing, said intermediate hollow cylindrical element having, at both its upper and lower ends, bearings which are aligned with each other but offset in relation to the axis of the first part of the shaft; and wherein the hollow cylindrical element of the backing plate is rotatably mounted in the bearing located at the lower end of said intermediate hollow cylindrical element, whereas the second part of the shaft is rotatably mounted at its upper end in the bearing located at the upper end of said intermediate hollow cylindrical element and is connected at its lower end to the backing plate.

4. The sanding head according to claim 3, wherein the second part of said shaft extends coaxially inside said hollow cylindrical element of the backing plate to the closed front end thereof, to which it is fixed by an axial securing screw.

5. The sanding head according to claim 1, wherein the lateral dust outlet pipe is long enough to to serve also as a handle.

6. The sanding head according to claim 1, wherein the means for securing the abrasive disk comprise a quick release device, in two parts, comprising mateials which adhere when pressed together, one part of which is stuck to the closed front end of the hollow cylindrical element of the backing plate and the other part of which is stuck to the abrasive disk.

7. The sanding head according to claim 1, wherein the other end of the shaft opposite said one end thereof is connectible to said motor means, said motor means being a motor unit of a drilling apparatus capable of receiving various accessories.

* * * * *